United States Patent [19]

Vidal

[11] Patent Number: 4,878,780

[45] **Date of Patent: * Nov. 7, 1989**

[54] APPARATUS AND METHOD OF CREATING AND CONTROLLING AN ARTIFICAL WATER TABLE

[76] Inventor: Stephen P. Vidal, P.O. Box 973, Anza, Calif. 92306-0973

[ * ] Notice: The portion of the term of this patent subsequent to Mar. 18, 2003 has been disclaimed.

[21] Appl. No.: 838,320

[22] Filed: Mar. 10, 1986

Related U.S. Application Data

[63] Continuation-in-part of Ser. No. 517,012, Jul. 25, 1983, Pat. No. 4,576,511.

[51] Int. Cl.[4] ..... E02B 13/00

[52] U.S. Cl. ..... 405/38; 405/50

[58] Field of Search ..... 405/36, 37, 38, 43, 405/45, 50

[56] References Cited

U.S. PATENT DOCUMENTS

| | | | |
|---|---|---|---|
| 3,307,360 | 3/1967 | Bailly | 405/38 |
| 3,408,818 | 11/1968 | Hemphill | 405/50 X |
| 3,625,010 | 12/1971 | Hakundy | 405/38 |
| 4,576,511 | 3/1986 | Vidal, Jr. | 405/37 |

FOREIGN PATENT DOCUMENTS

| | | | |
|---|---|---|---|
| 2405330 | 6/1979 | France | 405/38 |

*Primary Examiner*—David H. Corbin
*Attorney, Agent, or Firm*—Daniel C. McKown

[57] ABSTRACT

An underground structure formed of rock and cinders permits an artificial water table to be maintained at a selected distance below the ground level. The installation includes a watertight membrane that lines a basin excavated in the earth. A ballast layer of generally uniform size rock is laid on top of the watertight membrane in the basin, and the ballast layer is extremely permeable by water. The ballast layer is covered by a permeable membrane such as cloth. The permeable membrane is, in turn, covered by a layer of finely divided particles such as crushed volcanic ash or cinders. The particles of this fine layer are prevented from penetrating the ballast layer by the permeable membrane. The fine layer permits water to diffuse through it by capillary action. The fine layer is topped by a finish layer which is appropriate to the use to be made of the installation. Water is inserted in the ballast layer causing the water table in it to rise to and above the permeable membrane, the amount of water provided to the finish layer can be adjusted by raising and lowering the water level. A method of leveling the structure is described as well as automatic apparatus for maintaining a particular water level.

6 Claims, 3 Drawing Sheets

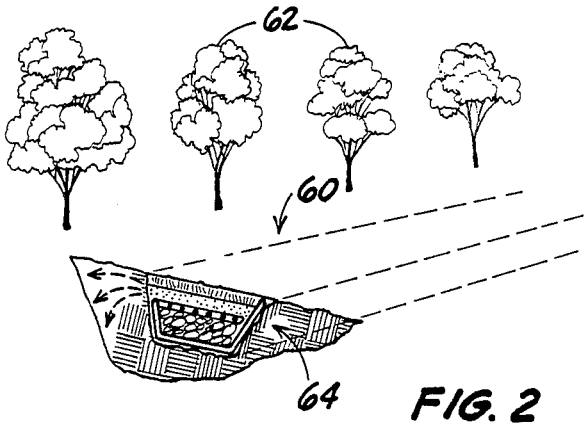
FIG. 2
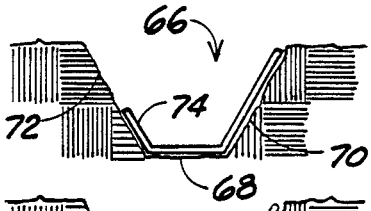
FIG. 3
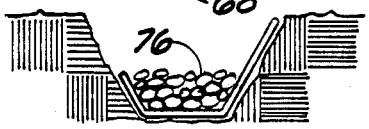
FIG. 4
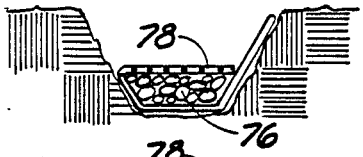
FIG. 5
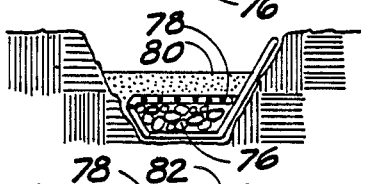
FIG. 6
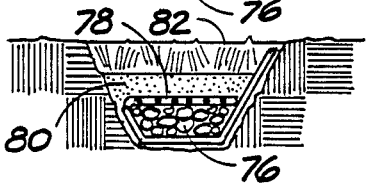
FIG. 7
FIG. 8
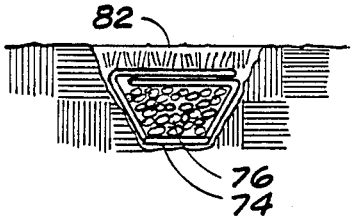
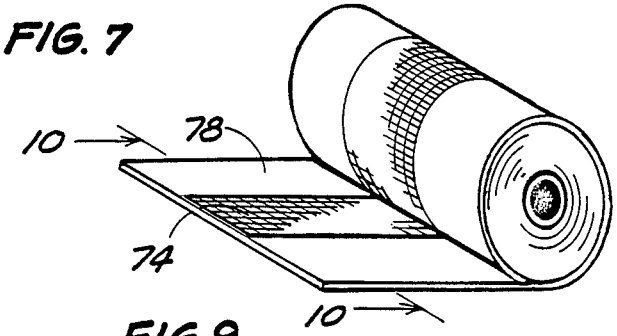
FIG. 9

APPARATUS AND METHOD OF CREATING AND CONTROLLING AN ARTIFICAL WATER TABLE

REFERENCE TO PARENT APPLICATION

The present application is a continuation-in-part of U.S. patent application Ser. No. 517,012 filed July 25, 1983 by the same inventor, and to be issued Mar. 18, 1986 as U.S. Pat. No. 4,576,511. The benefit of the priority of the parent application is hereby claimed under 35 U.S.C. §120 for subject matter common to both applications.

FIELD OF THE INVENTION

The present invention is in the field of construction and more specifically relates to a technique for controlling the amount of underground moisture supplied to a surface layer, while simultaneously stabilizing the surface layer. The technique of the present invention is particularly suitable for the construction of clay tennis courts, although it could equally well be applied to agricultural use.

THE PRIOR ART

In building railbeds for railroad tracks, it is known to place a layer of ballast stone on the ground as a first layer. The ballast stones are more or less of the same size. The ballast layer permits surface water to flow under the railroad tracks so that the railbed does not act to dam the flow of surface water.

In other structures, a layer of finer rock is sometimes placed on top of the ballast layer, and no effort is made to keep the layers separated. With the passage of time, and under the action of the elements, it is not unusual for the finer upper layer to work its way into the coarser lower ballast layer, thereby filling in the interstices of the ballast layer and thereby reducing its ability to pass the surface water.

In a different field of prior art, it is known to bury perforated pipes in the earth to provide irrigation for the soil. The water supplied to the pipes escapes through the perforations and is released into the soil. This drip irrigation technique, as currently practiced, is an excellent way to supply moisture to a pair of adjacent parallel rows of crops, but the current technique would prove to be hopelessly uneconomical and impractical for creating and maintaining an artificial water table.

In the event of a heavy rain, such an underground watering system can cause flooding because it includes no way of removing water from the ground.

Finally, the use of a system of buried pipes has the disadvantage that if a pipe should break it is very difficult to locate the break, and repair can be effected only by digging up the surface area.

Thus, it is seen that previously known underground watering systems have a number of defects that limit their usefulness.

SUMMARY OF THE INVENTION

The present invention overcomes many of the problems associated with underground watering systems that are known in the prior art and permits a much greater degree of control in the application of water.

The present invention permits an artificial water table to be established beneath a surface, and permits the depth of this artificial water table to be raised and lowered at will, and in response to rain, heat, wind and other environmental conditions.

In accordance with the present invention, a basin-like excavation is dug in the earth at the plot that is to be irrigated. The bottom of this excavation is carefully leveled, and then the floor and walls of the excavation are covered with a watertight membrane, such as stout plastic, to form a shallow watertight basin.

A ballast layer of rock is then laid down on the watertight membrane to a typical depth of 4 inches. The ballast layer consists of a myriad of rocks having approximately the same size. That size typically is in the range from 0.5 to 1.0 inches. In alternative embodiments, the ballast layer may consist of man-made materials such as glass marbles or even foraminous pipes of steel or plastic. The purpose of the ballast layer is to provide a medium for the lateral flow of water and to provide a firm support or foundation for the layers above it.

In accordance with the present invention, there is placed upon the ballast layer a permeable membrane that entirely covers the exposed upper surface of the ballast layer. The permeable membrane may consist of a durable fabric, such as denim, while in other embodiments, a metal or plastic screen is used. The inclusion of this permeable membrane is an important aspect of the present invention. The permeable membrane should provide only low resistance to the passage of water, but prevents finely divided rock from passing through it.

In accordance with the present invention, a layer of finely divided material is deposited on top of the permeable membrane. In a preferred embodiment, this fine layer consists of scoria or crushed volcanic ash. That material is very porous and because the material is finely divided, the surface tension of the water is broken and the water can disperse through the layer by capillary action "wick effect". The particles of the fine layer cannot penetrate downwardly through the permeable membrane because the particles are larger than the passages through the permeable membrane. For this reason, particles from the fine layer cannot get into the ballast layer and thereby clog up the ballast layer, which would interfere with the desired flow of water through the ballast layer.

Finally, a finish layer is deposited on the fine layer, and the nature of the finish layer depends on the use to be made of the installation. If the installation is to be a tennis court, the finish layer might consist of crushed granite or crushed basalt. On the other hand, if the installation is to be used for agricultural purposes, the finish layer may consist of top soil. In an alternative embodiment, the finish layer is omitted.

In accordance with the present invention, the watertight membrane extends upwardly at the perimeter of the installation so that all of the layers discussed above lie within the watertight basin formed by the watertight membrane.

A water supply pipe extends into the ballast layer and is used for supplying water to that layer. As the water level in the ballast layer rises, no irrigation of the fine layer or the finish layer takes place until the water level reaches the permeable membrane. Once the water level has risen above the permeable membrane, the water wets the scoria in the fine layer, and this layer acts like a wick or blotter so that the water penetrates upward through the fine layer by capillary action. Similarly, moisture is drawn into the finish layer by the same effect.

If the water level is permitted to continue to rise above the permeable membrane, moisture is supplied to the finish layer at an even faster rate.

A suction pipe also extends into the ballast layer, and reaches almost to the bottom of that layer, but is spaced slightly from the watertight membrane. This suction pipe is used for withdrawing water from the ballast layer, and this may be accomplished most readily through the use of a pump attached to the suction pipe. As water is removed from the ballast layer by the suction pipe, the artificial water table falls, at first merely reducing the rate at which water is supplied to the finish layer. However, when the water table has fallen below the permeable membrane, water will no longer flow into the fine layer, and the irrigation is terminated.

It is a feature of the present invention that the ballast layer readily conducts the water in all directions, so that an area the size of a tennis court can be irrigated through the use of only one water supply pipe, and only one suction pipe is required to remove the water. This action results from the uniformity of the stones in the ballast layer thereby resulting in interstices that cannot become clogged. Unlike systems that employ buried foraminous pipes that can break, the ballast layer is practically indestructible and trouble-free.

In the following detailed description, the techniques for constructing the irrigated plot and the techniques for controlling the artificial water table will be described in greater detail.

The novel features which are believed to be characteristic of the invention, both as to organization and method of operation, together with further objects and advantages thereof, will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

BRIEF DESCRIPTION OF THE DRAWINGS

FIG. 2 is a diagram showing a subsurface irrigation system for supplying moisture to an elongated strip of land;

FIG. 3 is a diagram showing in cross section step in the method of constructing the system of FIG. 2;

FIG. 4 is a diagram in cross section showing another step in the method of constructing the system of FIG. 2;

FIG. 5 is a diagram in cross section showing another step in the method of constructing the system of FIG. 2;

FIG. 6 is a diagram in cross section showing another step in the method of constructing the system of FIG. 2;

FIG. 7 is a diagram in cross section showing another step in the method of constructing the system of FIG. 2;

FIG. 8 is a diagram in cross section showing the structure of an underground water conduit;

FIG. 9 is a diagram showing a roll of a material used in constructing a subsurface irrigation system;

DETAILED DESCRIPTION OF THE PREFERRED EMBODIMENT

The method, materials and structure of the installation will now be discussed in detail with reference to FIG. 1. For purposes of illustration, it is convenient to think of the installation as being a tennis court, but the structure and method remain substantially the same, with possible changes in dimensions, when the installation is to serve some other use.

For example, the construction of the present invention is particularly well suited for the irrigation of crops that are sown broadcast as contrasted with row crops, because it provides moisture uniformly to the entire plot.

Figure 1:
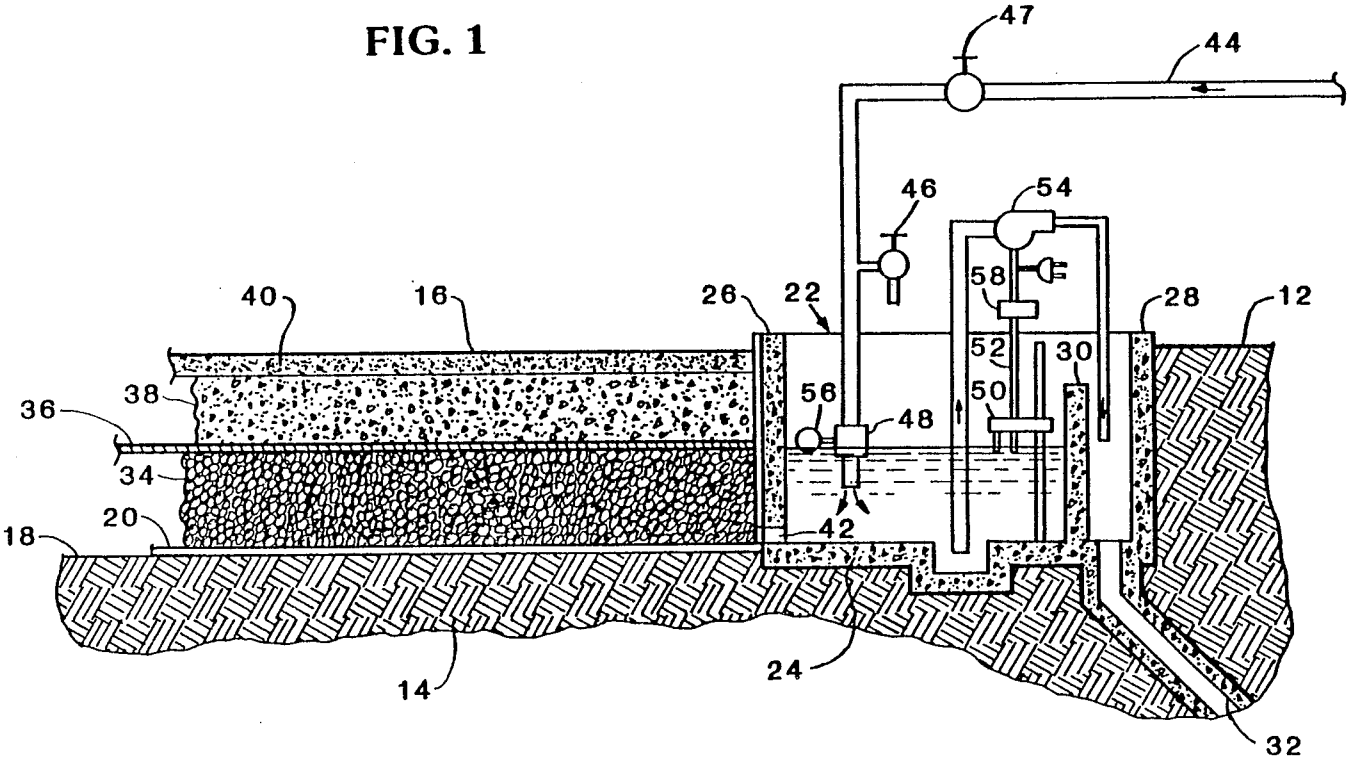
FIG. 1 is a diagramatic cross-sectional elevation view of an irrigated plot constructed in accordance with a preferred embodiment of the present invention.

In FIG. 1, the line 12 represents the ground level before the construction has been started.

A basin is then excavated in the earth 14. The depth of the basin is determined from the description given below, and typically the basin might be 6 inches to 12 inches in depth. The area and shape of the basin should be substantially the same as the area and shape of the exposed tennis court surface 16, and the walls of the excavation are preferably vertical.

It is extremely important that the floor 18 of the basin be level with variations across the width of the basin not exceeding an inch. This degree of accuracy is desirable to permit substantially all of the water to be drained from the structure if desired.

In the preferred embodiment, a watertight membrane 20 is laid down on the exposed floor and walls of the basin so as to form a watertight and water-containing liner for the basin. In the preferred embodiment, the watertight membrane 20 consists of a sheet of heavy gauge plastic of a type commonly used for providing moisture barriers in construction work. In an alternative embodiment, the watertight membrane is a sheet of tar paper. In another embodiment, the basin may be rendered watertight by the application of a coating that cures to form a watertight liner.

At some location on the perimeter of the tennis court, an excavation is made for a reservoir 22. Typically, the reservoir, as seen from above, may have an area of no more than several square feet. It is not necessary that the reservoir extend along the entire length of one of the sides of the tennis court. The reservoir 22 serves to contain the apparatus that is used to regulate the depth of the artificial water table.

As shown in FIG. 1, in a preferred embodiment the reservoir includes a floor 24 and walls 26, 28. A baffle 30 extends across the interior of the reservoir to set off a portion of it. That portion debouches into a sewer pipe or drain 32. Further description of the reservoir and the apparatus associated with it will be given below.

Returning now to the structure underlying the surface 16 of the tennis court, in the preferred embodiment, a ballast layer 34 is laid down upon the watertight membrane 20. In the preferred embodiment, the ballast layer consists of a myriad of rocks that are approximately the same size. The exact size of the rocks is immaterial as long as they are all of approximately same size so that the voids between the rocks remain open to permit water to move freely through the layer. In the preferred embodiment, the size of the rocks is in the range of 0.5 to 1.0 inches.

In an alternative embodiment, the rocks of the ballast layer 34 could be replaced by foraminous pipes, but these have the disadvantage of being more expensive and also subject to breakage.

In a typical installation, the ballast layer is 3 to 7 inches thick. It is desirable that the top of the ballast layer be level, and in accordance with the method aspect of the present invention, this may be accomplished by partially filling the basin with water to a depth approximately equal to the depth of the ballast layer 34. When this has been done, high spots in the layer will extend above the exposed surface of the water, while low spots in the ballast layer will lie below the surface of the water. Once the high spots and low spots have been detected in this manner, the high spots can be raked down to the level of the surface of the water and the low spots can be filled in.

Once the top of the ballast layer 34 has been made level, a permeable membrane 36 is laid on top of the ballast layer 34. The permeable membrane 36 is permeable to water, but prevents the overlying material in the fine layer 38 from penetrating into the ballast layer 34 and thereby clogging the voids in the ballast layer through which the water is intended to move freely. In the preferred embodiment, the permeable membrane consists of a heavy durable fabric like denim. In alternative embodiments, the permeable membrane may consist of a fine screen of plastic or metal.

A fine layer 38 is laid down on top of the permeable membrane 36. In the preferred embodiment, the fine layer consists of crushed volcanic ash, called scoria. In other embodiments, cinders or porous rock are used. The material of the fine layer is in the form of small particles, like sand, and the voids between the particles are extremely small so that water is rapidly dispersed through the fine layer 38. This rapid dispersion of water throughout the layer resembles the action of a blotter and is referred to herein as a "wicking action".

It should be understood that the fine layer 38 maintains its thickness and load-bearing ability whether moist or dry.

The top of the fine layer 38 is leveled by increasing the water level in the basin until the water level is approximately equal to the elevation of the top of the fine layer. At this condition, the high spots and low spots in the fine layer can be identified, and the variations can be smoothed. Thereafter, the water level within the basin may be reduced.

The final step in construction of the tennis court is to lay down a finish layer 40 on the top of the fine layer 38. The finish layer has the color and texture desired for the tennis court. In a preferred embodiment of the invention, the finish layer consists of crushed granite or crushed basalt. After the finish layer 40 has been laid down, it may be leveled by once again raising the level of the artificial water table in the basin to a level approximately equal to the elevation of the exposed surface 16 of the tennis court. Thereafter, the variations may be evened out to render the exposed surface 16 level and smooth.

Now that the construction of the installation has been described, the method and apparatus used for raising and lowering the depth of the artificial water table will now be explained. It must be remembered that the porous nature of the finish layer 40, the fine layer 38, the permeable membrane 36 and the ballast layer 34 permits rain or melting snow that falls upon the tennis court to enter the watertight basin defined by the watertight membrane 20. Normally, it is desirable to maintain the water table at a particular depth beneath the exposed surface 16.

The wall 26 includes a passage 42 near the floor 24 of the reservoir which permits the reservoir 22 to communicate with the basin defined by the watertight membrane 20. As a result, the water level in the reservoir accurately indicates the level of the water table beneath the tennis court. An optimum level for this water table is maintained by the apparatus now to be described.

The incoming water line 44 includes a shutoff valve 47 that can be used if one chooses to drain the water from the basin. The incoming water line 44 also includes a manually operated fill valve 46 that permits the water table to be raised at will. A float valve 48 adds water to the reservoir 22 automatically when the water table falls below a preset level.

If the level of the water table is at the desired preset level maintained by the float valve 48 and thereafter a heavy rainfall occurs, the water table will begin to rise. As the water table rises, it may eventually reach the sensor 50 that will close an electrical circuit indicated by the wires 52 thereby starting the drain pump 54 that removes water from the reservoir 22 and deposits it in the drain pipe 32, thereby lowering the water table.

Normally, the action of the float valve 48 and the drain pump 54 are adequate to maintain the water table between preset limits. These preset limits are chosen by selecting the height of the float portion 56 of the float valve 48 and by adjusting the height of the sensor 50. In this way, any desired water table level can be selected and automatically maintained.

On occasion it may be desirable to raise temporarily the water table. This may be done by unplugging the source of electrical power to the pump 54 and opening the fill valve 46. When it is desired to lower the water table again, the pump 54 is reconnected to its source of electrical power and the valve 46 or the valve 47 is closed.

The system of the present invention further includes protective features to guard against too high a level of the water table, as might happen if during a rain storm the electrical power for driving the pump 54 were to fail. The height of the baffle 30 is equal to the height of the maximum water table that is to be permitted. If a severe rainfall were to raise the water table above the height of the baffle 30, the water would then pour over the baffle 30 and be disposed of in the drain 32.

A switch 58 is provided for selectively connecting under control of the user the wires 52 together, thereby overriding the action of the sensor 50 (which does the same thing) and thereby causing the pump 54 to operate. If simultaneously the shutoff valve 47 is closed, all of the water can be removed from the installation.

Thus, there has been described a structure for producing an artificial water table, a method for constructing the structure and installation, and an apparatus and method for controlling both automatically and manually the level of the artificial water table.

Although the installation has been described as a tennis court for purposes of illustration , it must be remembered that the installation could equally well be used for the growing of crops, either in fields or in a greenhouse or for the maintenance of a lawn.

In this regard, FIG. 2 is a diagram, partially in cross section, showing a particularly advantageous embodiment of the present invention in the form of a subsurface irrigation system for supplying moisture to an elongated strip of land. In the application shown, the elongated strip 60 of land is the soil in which the row of trees 62, or vines or other plants are standing. Because the plants may already be in place before the irrigation system 64 is installed, the irrigation system is installed adjacent the elongated strip of land. This also discourages the roots from attacking the irrigation system.

As best seen in FIG. 7, the irrigation system of FIG. 2 includes all of the elements of the system shown in FIG. 1, and the major difference is that in the embodiment of FIGS. 2–7, the structure has a more elongated form.

FIGS. 3–7 show successive stages in the construction of the irrigation system of FIG. 2 and illustrate the placement of the various components.

Initially, a ditch 66 is dug in the land, and it includes a bottom 68 and upwardly slopping sides 70, 72. As seen in FIG. 3, a sheet 74 of water-impermeable material is placed in the ditch so as to cover the bottom and to extend at least part way up the sides of the ditch. Thus, there is formed a watertight trough in the bottom of the ditch 66.

As shown in FIG. 4, a ballast layer 76 is placed into the watertight trough. This ballast layer 76 consists mostly of rocks or other impermeable objects having approximately the same size, so that there are no smaller objects to clog the interstices between the rocks, through which the water is to flow.

As shown in FIG. 5, a sheet 78 of permeable material is laid over the ballast layer 76 to prevent finer materials from working into the ballast layer and clogging the passage ways.

As will be discussed more fully below, it is usually convenient to attach the permeable sheet 78 to the water-impermeable sheet 74 to keep it in place during subsequent operations. Thereafter, a fine layer 80 is laid down on top of the permeable sheet 78. The fine layer is composed primarily of fine particulate material through which water is dispersed by capillary action.

Finally, as shown in FIG. 7, a layer 82 of top soil is laid down on top of the fine layer 80 to complete the structure.

If it is desired merely to transport water without providing any irrigation effect, the modification of the system shown in FIG. 8 should be used. It consists of a ditch in whcih a water-impermeable sheet 74 surrounds the ballast layer 76. The conduit thus formed is covered by a layer 82 of top soil.

As shown in FIG. 9, where the irrigation system takes the form of an elongated strip, it is advantageous to supply the water-impermeable sheet 74 and the permeable sheet 78 in the form of a roll from which the material can be unrolled into the ditch.

FIGS. 10–15 show cross sections taken through the material of FIG. 9, and illustrate some of the forms the product can take.

Figure 10:
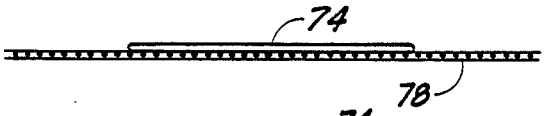
FIG. 10 is a diagram showing a cross section of a product used in constructing an underground irrigation system.
Figure 11:
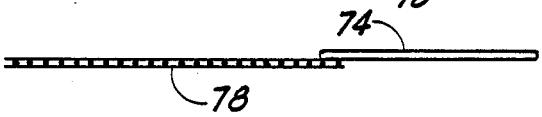
FIG. 11 is a diagram showing a cross section of another product used in construction of an underground irrigation system.

For example, in FIG. 10, the sheet of water-impermeable material 74 is bonded at a central location on the sheet 78 of permeable material. In FIG. 11, only the edge of the sheet 74 of water-impermeable material is bonded to the edge of the sheet 78 of permeable material. In FIGS. 10 and 11, the bonding is accomplished by a thin coating of adhesive between the sheets. In other embodiments, the bonding is accomplished by welding.

Figure 12:
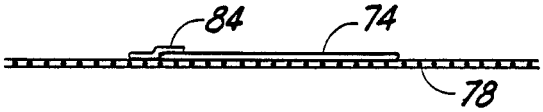
FIG. 12 is a diagram showing a cross section of another product used in constructing an underground irrigation system.
Figure 13:
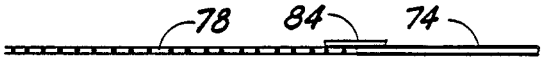
FIG. 13 is a diagram showing a cross section of another product used in constructing an underground irrigation system.

FIGS. 12 and 13 illustrate the use of a strip 84 of adhesive tape to connect the layers together.

Figure 14:
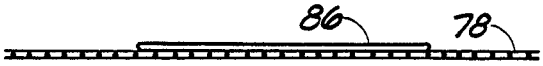
FIG. 14 is a diagram showing a cross sectional view of another product used in constructing an underground irrigation system.
Figure 15:
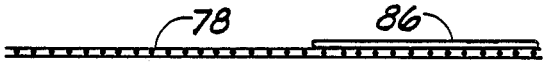
FIG. 15 is a diagram showing in cross section another product used in constructing an underground irrigation system.

In FIGS. 14 and 15, the water impermeable sheet is formed by applying a water impermeable coating 86 to the sheet 78 of permeable material.

Figure 16:
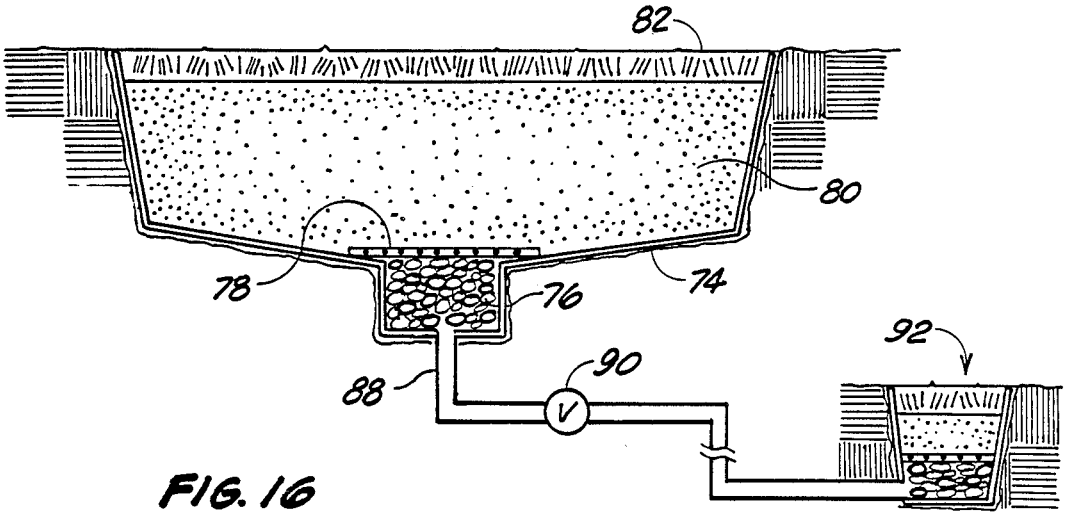
FIG. 16 is a diagram showing in cross section an underground storage reservoir constructed in accordance with the present invention.

The structure shown in FIG. 16 illustrates a different type of application for the structure described above. In the embodiment of FIG. 16, the structure is used as a reservoir in which excess water is trapped and stored for later use. The water is stored primarily in the fine layer 80, which in one embodiment consists of sand. The sheet of permeable material 78 serves mainly to prevent the finer material above it from working into and clogging the interstices of the ballast layer. The water-impermeable sheet 74 lines a basin dug in the earth and includes provision for a drain 88 by which the water can be removed from the ballast layer 76. In the best mode of practicing this invention, a valve 90 is included in the drain line 88 for the selective release of water from the ballast layer 76. In the application shown in FIG. 16, the stored water is used to supply an irrigation system 92. The reservoir and the irrigation system 92 can, of course, be separated by a considerable distance. For example, the reservoir could be located on a side of a mountain range that receives considerable percipitation, while the irrigation system 92 could be located on the drier side of the mountain range.

As indicated in FIG. 2, the water supplied by the subsurface irrigation system will disperse laterally through capilliary action unless the impermeable sheet 74 extends almost to the top of both sides 70, 72 of the ditch 66. The user has the option of deciding in which direction he wishes the dispersal of the water to take place. If the impermeable sheet 74 extends to the top of the ditch on both sides of the ditch, then the irrigation effect will be confined mainly to the area at the top of the ditch. On the other hand, if the impermeable sheet 74 extends only partially up one side of the ditch, then the water will disperse from that side of the ditch as indicated in FIG. 2. In an application where the system is installed between two rows of trees, the user might well choose to terminate the impermeable sheet 74 at the elevation of the permeable sheet 78 so that the water can readily disperse to both sides of the ditch, thereby watering both rows of trees simultaneously.

It is also evident that the reservoir of FIG. 16 can be constructed in an elongated shape, so as to catch all of the runoff from a sloping field.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A subsurface irrigation system for supplying moisture to an elongated strip of land, comprising:

a ditch having a bottom from which two walls extend upwardly;

a strip of water-impermeable material covering the bottom of the ditch and extending at least part way up the sides of the ditch, thereby forming a watertight trough;

a ballast layer within the watertight trough, of substantially uniform thickness, and including interstices through which water can flow in any direction;

a fine layer composed predominantly of fine particulate material through which water is dispersed by capillary action; and, a strip of permeable material through which water can pass readily but through which the fine particulate matter of said fine layer cannot pass, bonded to said sheet of water-impermeable material, disposed on top of said ballast layer, and on which said fine layer rests, whereby said strip of permeable material prevents the fine particulate material of said fine layer from settling into said ballast layer and clogging the interstices of said ballast layer thereby choking off the flow of water through said ballast layer.

2. The subsurface irrigation system of claim 1 in which said strip of water-impermeable material extends at least to the top of one side of said ditch.

3. The subsurface irrigation system of claim 1 wherein said permeable material is a fabric.

4. A method of constructing a subsurface irrigation system for supplying moisture to an elongated strip of land, said method comprising the steps of:

(a) forming a ditch lengthwise of the strip of land, the ditch having a bottom from which sides extend upwardly;

(b) laying a strip of water-impermeable material lengthwise within the ditch so that it covers the bottom and extends at least partly up the sides of the ditch to form a watertight trough that extends lengthwise in the ditch;

(c) covering the watertight trough with a ballast layer consisting generally of rocks of substantially uniform size;

(d) covering the ballast layer with a strip of permeable material that extends lengthwise within the ditch so that it completely covers and rests on the ballast layer;

(e) bonding the strip of permeable material to the strip of water-impermeable material, so as to completely enclose the ballast layer;

(f) covering the strip of permeable material with a fine layer composed predominantly of fine particulate material through which water is dispersed by capillary action;

(g) filling in the ditch with a finish layer of vegetation growing soil.

5. A method for constructing a subsurface irrigation system for supplying moisture to an elongated strip of land, said method comprising the steps of:

(a) bonding an elongated strip of water-impermeable material to an elongated strip of permeable material to form a combined strip;

(b) forming a ditch lengthwise of the strip of land, the ditch having a bottom from which sides extend upwardly;

(c) laying the combined strip lengthwise into the ditch so that the elongated strip of water-impermeable material covers the bottom of the ditch and extends at least partly up the sides of the ditch to form a watertight trough that extends lengthwise in the ditch and so that the elongated strip of permeable material is exposed;

(d) covering the watertight trough with a ballast layer consisting generally of rocks of substantially uniform size while keeping the elongated strip of permeable material exposed;

(e) covering the ballast layer with the strip of permeable material so that the strip of permeable material completely covers the ballast layer;

(f) covering the strip of permeable material with a fine layer composed predominantly of fine particulate material through which water is dispersed by capillary action; and, (g) filling in the ditch with a finish layer of a vegetation growing soil.

6. In a method of building an underground water conductor, comprising the steps of:

forming a ditch having a bottom from which two walls extend upwardly;

covering the bottom of the ditch with a sheet of water-impermeable material that has lateral portions that initially extend at least part way up the sides of the ditch, thereby forming a watertight trough;

partially filling the watertight trough with a ballast layer consisting generally of rocks of substantially uniform size;

folding the lateral portions of the sheet over the ballast layer to enclose it;

covering the folded-over lateral portions of the sheet with a layer of earth; and, filling up the ditch with earth.

* * * * *